United States Patent [19]

Székács

[11] 4,329,614

[45] May 11, 1982

[54] SEALED-BEAM HEADLIGHT

[75] Inventor: György Székács, Budapest, Hungary

[73] Assignee: Egyesült Izzolampa es Villamossagi RT, Budapest, Hungary

[21] Appl. No.: 127,617

[22] Filed: Mar. 6, 1980

[30] Foreign Application Priority Data

Mar. 7, 1979 [HU] Hungary ..... EE 2639

[51] Int. Cl.[3] ..... H01J 5/16

[52] U.S. Cl. ..... 313/115; 313/113; 313/316; 362/296

[58] Field of Search ..... 313/115, 113, 316, 271, 313/272, 222; 362/296

[56] References Cited

U.S. PATENT DOCUMENTS 3,023,667 3/1962 Lessman ..... 313/115

FOREIGN PATENT DOCUMENTS 2840537 3/1980 Fed. Rep. of Germany ..... 313/115

*Primary Examiner*—Davis L. Willis

[57] ABSTRACT

An electric light source for use in a vehicle headlight unit capable of emitting dipped light beams, especially a sealed-beam headlight unit. The light source has a single filament or two-filament halogen lamp and an inner or outer screen element preventing the incidence of light from the dipping filament on the reflector. The shape of the rim of the screen element is a specially developed three-dimensional curve, whereby a distribution of the projected light is achieved which does not blind the drivers of oncoming vehicles. The shape of the three-dimensional curve forming the rim of the screen element can be determined point-by-point from the light distribution required, taking into consideration prescribed geometrical interrelations.

12 Claims, 9 Drawing Figures

SEALED-BEAM HEADLIGHT

The invention relates to an electric incandescent lamp unit, and particularly to a unit which is also capable of emitting a dipped light beam; in preferred embodiments the invention relates to a sealed-beam type vehicle headlight unit having a parabolic reflector (mirror) and a halogen incandescent lamp with at least one incandescent body (filament) arranged close to the focus of the parabolic reflector. This unit has a glass closure plate for sealing off the reflector space. A secondary spiral filament incandescent body emitting the dipped beam is screened by a light shield element mounted to prevent the direct incidence of light on the parabolic reflector within a zone of at most 180°, measured in consecutive planes perpendicular to the axis of the paraboloid defined by the reflector.

It is known that the light distribution of the British-American type sealed beam headlights is obtained by using coils or filaments in the lamps the axes of which are perpendicular to the axis of rotation of the reflector. The lamp filament providing the full "main beam" is located in the focus of the reflector. The dipping filament providing the downwardly directed dipped light beam is positioned slightly off-focus in an upward and lateral direction. It thus mainly illuminates the curbside of the road and does not dazzle the drivers of the oncoming vehicles. Due to the character of the U.S. highway network and the developed pattern of vehicular traffic, the U.S. Standards set relatively mild norms or requirements regarding the shape of the dipped beam, particularly with respect to a sharp definition of the boundary and the geometry of the dark and bright zones.

The situation however is different in Europe, where the road network consists of relatively narrow, undivided roads mainly accommodating mixed traffic, and where the anti-dazzle regulations protecting the drivers of the oncoming vehicles have been particularly rigorously implemented from the very beginning for reasons of road safety. Thus, rigorous and clear standards have been accepted internationally as regards the light emitted by dipped beams of vehicle headlamps.

These standards for the specially developed and generally used vehicle headlights capable of providing applied dipped beams and having one or two filaments are met by an internal lamp structure wherein the axis of the lamp coil filament coincides with or is parallel to the axis of light reflection of the lamp and the emitted light is screened in a well-defined angular zone around the axis of the coil, thus controlling the shape of the emitted beam.

Recently, in the course of the development of halogen lamps, experience has shown that one of their most favorable fields of application is road vehicle lighting. This is because of the increased demands of road and vehicle illumination due to the increased speeds of vehicles. The light output of halogen lamps is better with identical energy consumption, remains more uniform during their life, and the lamps can be constructed in an advantageously relatively simple manner. Initially, during the period of efforts to overcome the difficulties originating from the disadvantageous internal reflections due to the relatively small diameter of the cylindrical lamp bulb, two-filament halogen lamps switchable between main and dipped beam in the same headlight unit were generally used, particularly in Europe, to satisfy the above-mentioned and essentially unchanged severe requirements regarding the shape and characteristics of the dipped beam. At the same time, it also became clear that the axial mounting, i.e. the positioning of the alternately glowing lamp filaments one behind the other does not affect the functioning of the tungsten-halogen cycle which is so important for the efficient operation of the halogen lamp.

The difficulties effecting light distribution according to the European Standards for two-filament vehicle lamps and their possible solution have been dealt with, among others by British Pat. Nos. 1,178,492 and 1,166,158 and by German (FRG) Pat. Nos. 1,911,933; 1,928,978 and 2,145,128. It is a common feature of these patents that they all use an internal or external screen element or screening layer positioned around the longitudinally arranged dipped beam filament, screending a predetermined cylindrical angular zone of preferably 165° to 180° with its outlines or contours lying in planes intersecting the axis of the filament and determining the cylindrical angle. According to a generally used solution, the screen is a cap-like element positioned directly adjacent to the dipped beam filament and having the characteristics described above.

In German Published Application No. 2,322,369 (Hungarian Pat. No. 165,038) there has been suggested a screen deviating from the traditional but which, from the point of view of the Standards, is still permissible. This screen is favorable as regards road safety and has a stepped, Z-shape producing an asymmetric dipped beam. The outline of the rim or edge of this screen extends along a spatial i.e. three-dimensional curve, rather than along a planar curve. The carrier surface of this is a curve, preferably a cylindrical envelope or surface. The results of experiments have, however, shown that a sharp cut-off of the dark/bright zone can be achieved only with difficulty due to the already mentioned undesirable internal light reflections and the effects of the reflections from the curved rim of the suggested cap-like screen.

An object of the invention is to provide a light source, preferably a vehicle headlight unit of the sealed beam type with a parabolic reflector comprising a halogen incandescent lamp fitted in the mirror space of the reflector which, due to the design of its screen element insures a light distribution which meets the requirements of the U.S. Standards i.e. which is similar to the traditional light distribution of the customary sealed beam headlight units, while at the same time utilizing and maintaining all the above-mentioned advantages of halogen vehicle lamps and being capable of forming vehicle halogen sealed-beam headlamps with two filaments, i.e. alternately providing main and dipped beam sealed-beam headlights.

This object of the invention is achieved by the construction of an electric headlight unit, wherein according to the invention the rim of the screen element is developed along a three-dimensional curve in such a way that any randomly selected plane extending radially from and including the axis of the paraboloid of the reflector contains at most two points only of the three-dimensional curve.

The invention is based on the discovery that by the application of a screen element rim or edge shaped as a three-dimensional curve, deviating from hitherto known shapes, the light beams obtained may be disposed practically without loss of light intensity in a range lying around the points of maximum light intensity as required by the European Standards. Although the projected asymmetric light beam has no sharp cut off, it has no zones of high, i.e. inadmissibly bright light intensity in directions above the horizontal.

In preferred embodiments of the electric headlight unit according to the invention, the points of the three-dimensional curve defining the rim of the screen in planes perpendicularly intersecting the axis of the parabolois of the reflector in zones or ranges inclined to the horizontal passing through the axis at an angle of ±30°, and at least in certain ranges of the longitudinal extension of the screen in the direction of the axis of the paraboloid, lie on the surface of a body of revolution in such range, particularly on the surface of a cylinder, a cone, or a sphere.

In vehicle headlight units according to the invention, with two-filament halogen incadescent lamps, the screen element is preferably placed inside the gas-filled interior of the halogen incandescent lamp. In headlight units constituted by single-filament vehicle lamps providing dipped beam light only, the screen element is expediently placed in the reflector space outside the gas-filled interior of the halogen lamp bulb, thus rendering the use of the customary single-filament type halogen incandescent lamps possible.

According to the invention an additional screen element may be expediently placed in the vehicle headlight reflector unit in such a way that it prevents the direct incidence of light on the glass front plate which seals the parabolic reflector. This screen may be any known heat resistant metal component or e.g. a heat-resistant paint layer coated on the bulb of the halogen lamp.

The invention is described, purely by way of example, with reference to preferred embodiments illustrated in the accompanying drawings, wherein.

Figure 8:
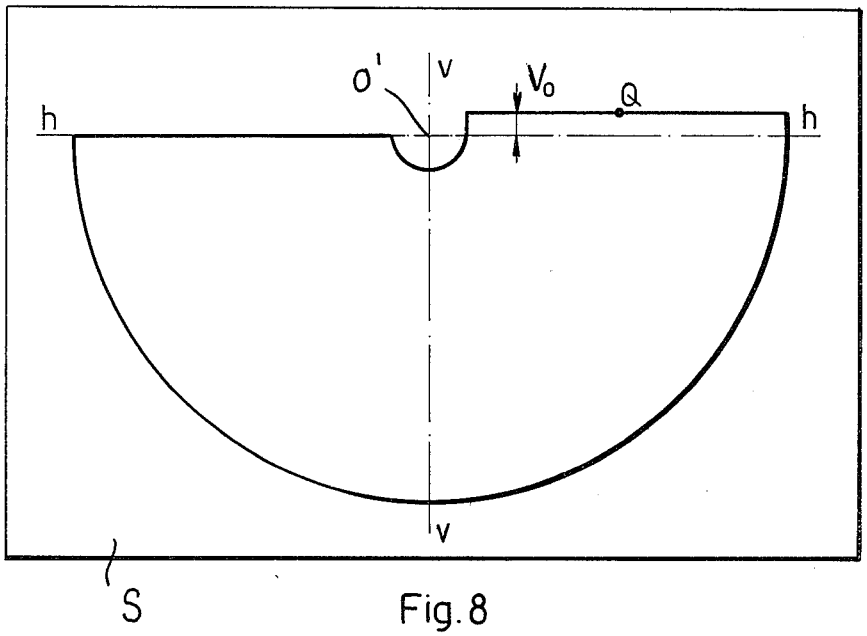
Figure 9:
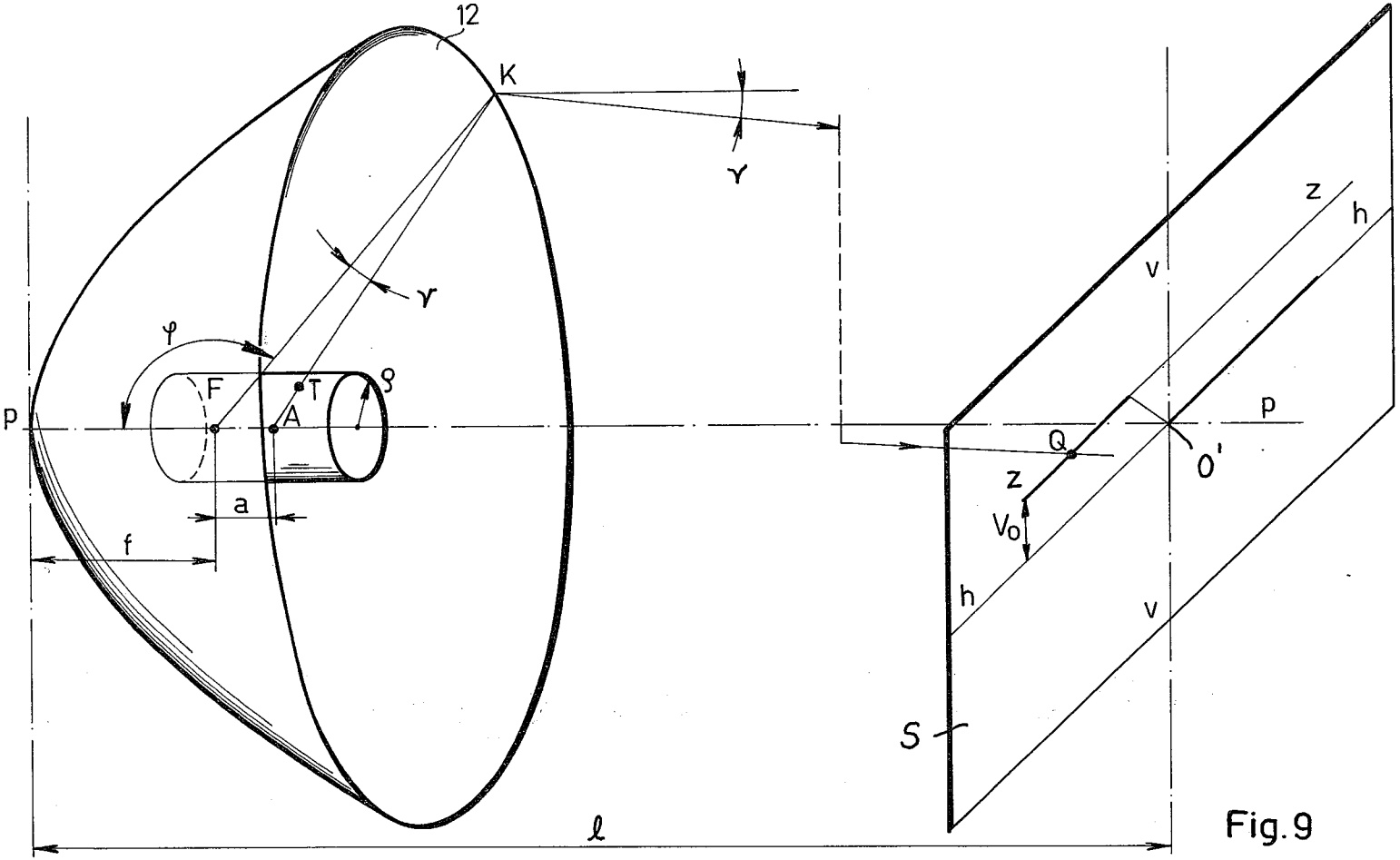

FIG. 8 shows the image projected on a screen for measuring the light distribution achievable by a headlight reflector unit according to the invention, FIG. 9 is a diagrammatic view in perspective which is compressed in a horizontal direction along the light beam falling on a screen, the view illustrating, for an exemplary screen element of a headlight unit having a rim of three-dimensionally curved shape, the elementary geometrical and optical interrelations of the path of the beam projected on the surface of a cylinder surrounding the dipping filament, according to the required light distribution.

Figure 1:
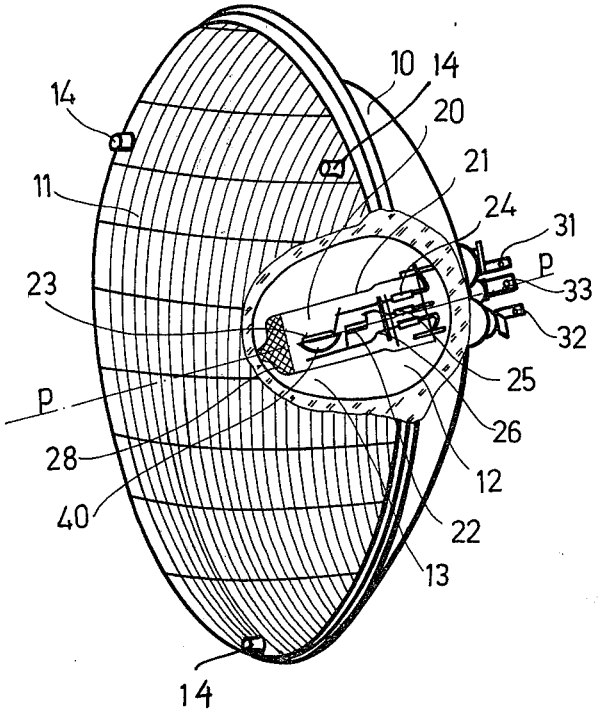
FIG. 1 is a perspective view of a first embodiment, such embodiment being a sealed-beam headlight unit with a two-filament halogen lamp a portion of the unit being broken away to show the internal structure of the unit.

Turning first to FIG. 1, there is shown a preferred embodiment of an electric sealed-beam type vehicle headlight unit 10 according to the invention wherein a two-filament halogen lamp 20 is arranged inside the reflector space 13 of the unit. Within the space 13 there is a parabolic reflector 12. The space 13 is sealed by a prismatic glass front plate 11 in such a way that the dipping filament 23 is located in front of and close to the focal point disposed on the axis p—p of the reflector and the main beam filament of the halogen lamp 20 is located essentially at the focal point.

In this embodiment, the alternately switchable main beam filament 22 providing the long, main beam and the dipping, short beam filament 23 are mounted axially, one behind the other inside the gas-filled tubular bulb 21 of the halogen lamp 20. The bulb 21 is made of a material of high melting point and is sealed by a pinch seal. The positions of the filaments are fixed by their fastenings on the current-conducting electrodes (lead-ins) 24, 25, 26 connected to respective terminals 31, 32 and 33.

A screen element 40 designed according to the invention determines the required or prescribed distribution of the emitted dipping beam of the filament 23. The screen 40 surrounds the latter and is secured to the electrode 26 by welding. In order to ensure that only directed light beams reflected from the parabolic reflector 12 emerge through the prismatic glass plate 11, an additional screen element 28, in this particular embodiment an opaque (black) coating layer on the end of the bulb 21 is placed in the path of the light passing towards the sealing plate 11 directly from the filaments 22, 23. The interchangeability, that is, the ready removability and replaceability of the sealed beam headlight unit 10 in relation to the vehicle is assured by per se known locating attachment elements 14.

Figure 2:
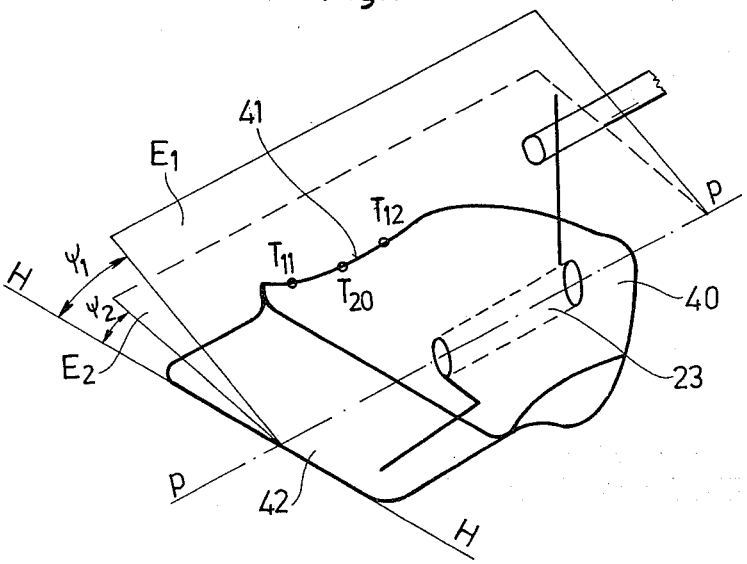
FIG. 2 is a fragmentary enlarged perspective view of the dipping filament and the screen element of a halogen lamp used in the headlight unit according to FIG. 1.

FIG. 2 is an enlarged perspective view showing in detail the dipping filament 23 and the screen unit 40 of the headlight unit 10 shown in FIG. 1. It can be seen in FIG. 2 that the rim 41 of the screen element 40 has the contour of a three-dimensional curve. According to the invention, at most two points $T_{11}$ and $T_{12}$ lie in the plane $E_1$ which includes the axis p—p; the plane $E_1$ originates and radially extends from the axis p—p and subtends an angle $\psi_1$1 (psi $^1$) with the horizontal H—H.

Another plane $E_2$, subtending an angle $\psi_2$ (psi$_2$) with the horizontal H—H and touching the three-dimensional curve 41 only from underneath, contains only one point $T_{20}$ of the three-dimensional curve. According to this invention, it holds true for any randomly selected plane E that such curve can contain at most only two points $T_1$, $T_2$ in common with the rim 41; therefore the three-dimensional curve has no section which is either a straight line or which lies in any given plane. The screen element 40 is also provided with an extension 42 to which one leg of the dipping filament 23 can be fastened by welding.

Figure 3:
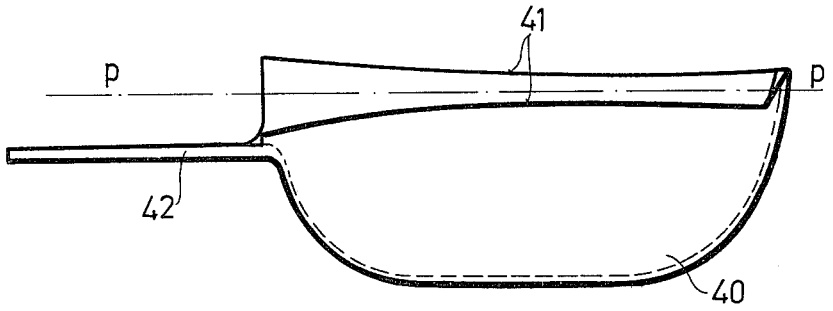
FIG. 3 is a side view of an exemplary screen element.
Figure 4:
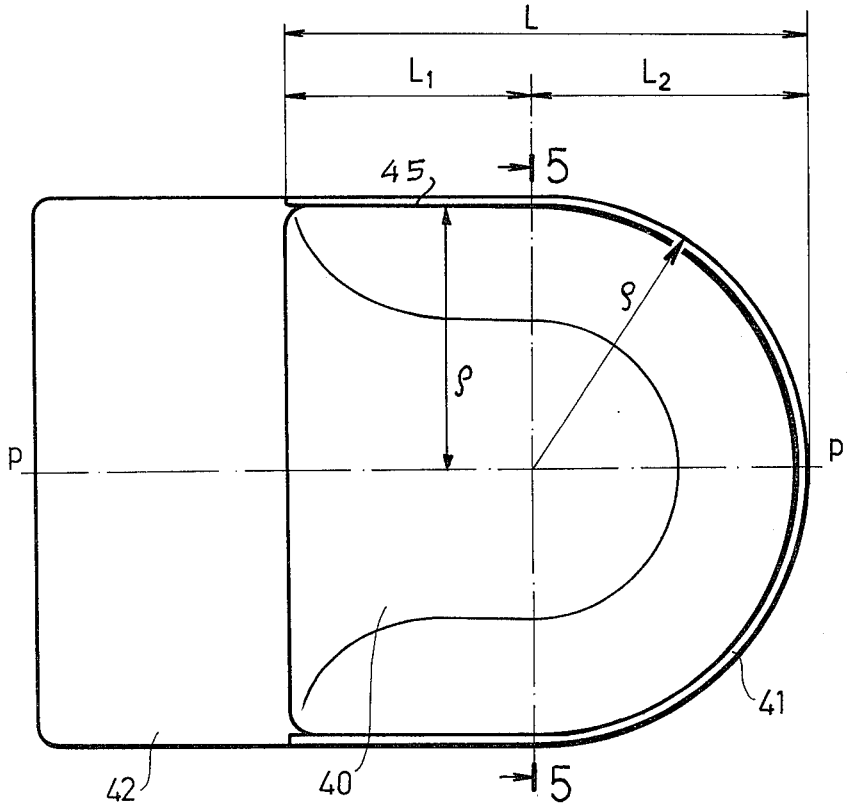
FIG. 4 is a plan view of the screen element in FIG. 3.
Figure 5:
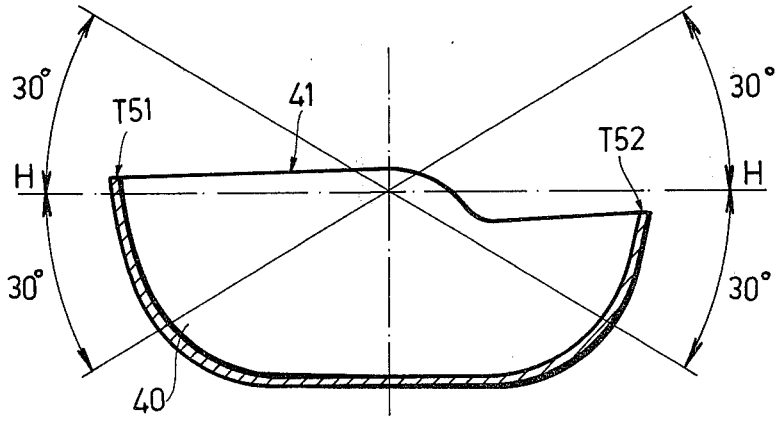
FIG. 5 is a section along the plane 5—5 in FIG. 4.

A preferred embodiment of the screen-element 40 made from a thin, deep-drawn molybdenum plate is shown in FIG. 3 in side view, and in FIG. 4 in plain view, while FIG. 5 shows it in a cross-section along the plane 5—5 of FIG. 4, perpendicular to the axis p—p of the parabolic reflector.

FIG. 5 well illustrates a characteristic feature of the invention, namely that the points T of the three dimensional curve constituting the rim 41 of the screen element 40 are located in planes perpendicularly intersecting the axis p—p of the paraboloid, in successive zones defined by sectors with an angle of ±30° with the horizontal plane H—H; this is clearly illustrated in FIG. 5, as an example, regarding the points $T_{51}$ and $T_{52}$ in the sectional plane 5—5. According to another expedient characteristic feature of the invention, the points T of the three-dimensional curve forming the rim 41 of the screen-element 40 lie, in the sections $L_1$ and $L_2$ of the lengthwise extension L (FIG. 4) of the axis of the paraboloid p—p, the surface of solid bodies which are preferably coaxial with the axis p—p of the paraboloid, e.g. a cylinder 45 with an axis 0 and a radius $\rho$ (rho) in section $L_1$, while in section $L_2$ a hemisphere 46, also of radius $\rho$.

Figure 6:
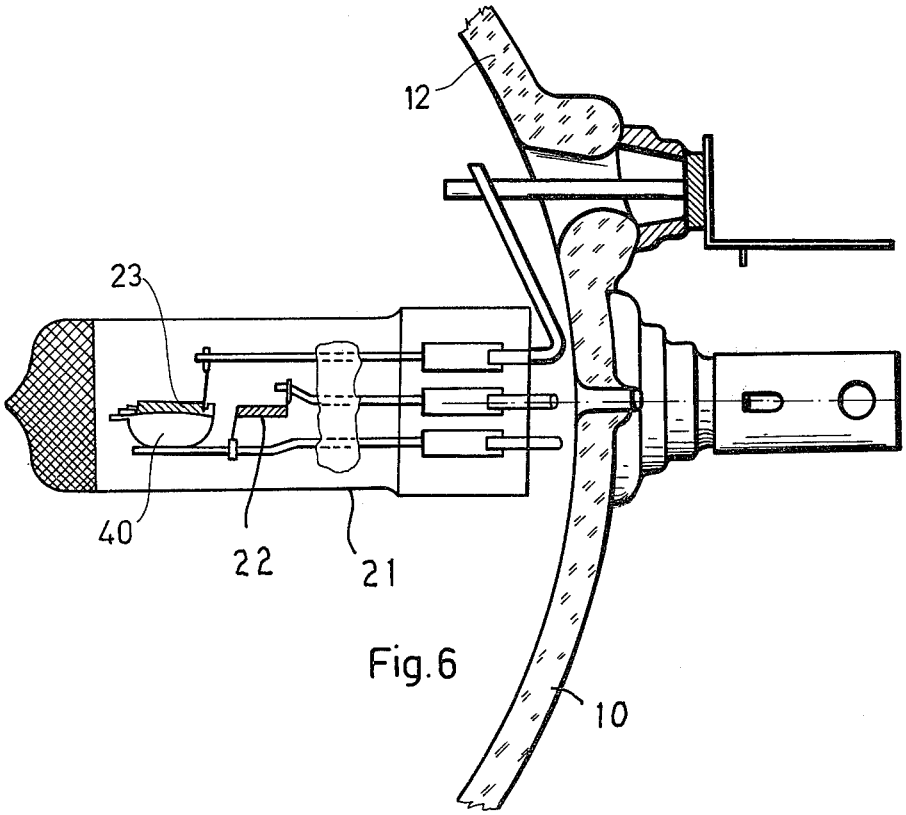
FIG. 6 is an enlarged part-sectional, part-elevational view of details of a two-filament halogen lamp and the parabolic reflector.
Figure 7:
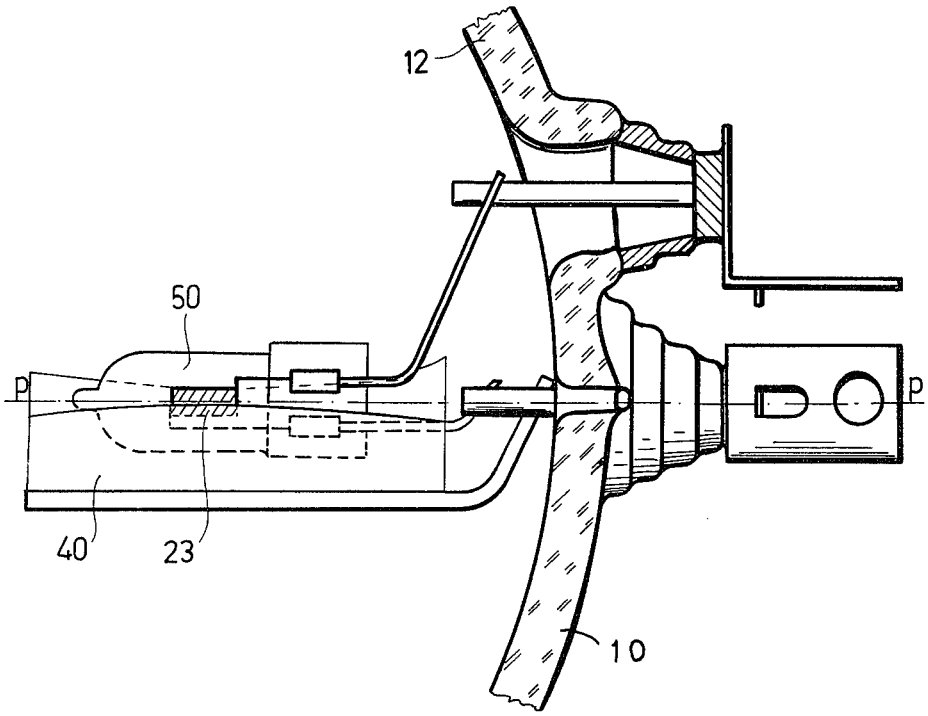
FIG. 7 is an enlarged view similar to FIG. 6 of details of a vehicle headlight unit provided with a single filament halogen lamp and a screen element located outside the gas-filled interior of the lamp.

FIG. 6 shows an embodiment with the screen element 40 located inside the bulb 21 of a two-filament halogen lamp 20, while FIG. 7 illustrates an embodiment with the screen-element 40 arranged outside the gas-filled interior of a single-filament halogen lamp 50 but within body of the parabolic reflector (shaded area in the drawing) around the dipping filament 23.

FIGS. 8 and 9 illustrate the distribution of light which e.g. in the case of traffic driving on the right well approximates the pattern of the distribution of light prescribed by the U.S. Standards and which can be satisfied by the traditional sealed-beam headlight units. In FIG. 8 the light pattern on a screen S is viewed from the location of the lamp. The pattern of the light distribution is shown, as usual, in FIG. 9 on the screen S with orthogonal axes h—h (horizontal), v—v (vertical), set up at a distance L from the parabolic reflector 12, wherein the origin O' of the coordinate system h—v is on the axis p—p and the plane of the screen is perpendicular to the axis p—p. The light distribution is characterized in that (in the case of traffic driving on the right) it has no illuminated zone of high light intensity, and cannot have such a zone in the range located to the left (FIG. 9) of the axis v—v and above the axis h—h; nor are there such zones in the range located to the right of and above the axis v—v and above the straight line z—z disposed at a constant distance $v_o$ above from the axis h—h.

A light distribution pattern according to FIG. 8 can be achieved by means of screen elements with rims formed by three-dimensional curves according to the invention. According to the elementary geometrical interrelations illustrated in FIG. 9, the three-dimensional curve constituting the contour of the rim of the screen element consists of a plurality or rather of the totality of points T, which are all and essentially the points of intersection of the beam paths A-K-Q, and of the surface of a body of rotation, preferably and as particularly shown in FIG. 9 of a cylinder, of radius $\rho$, the axis of which is coincident/or only parallel/with the axis p—p. It has to be understood that all ray or beam paths A-K-Q emerge from bright lighting elementary points A of a substantially heated incandescent body, i.e. such of a lamp filament of the length a, and reflected by an elementary section of a parabolic mirror surface at point K so as to be directed into points Q ranged along the boundary line of the dark and bright zones of the desired light pattern shown in both FIGS. 8 and 9. Thus, point K in FIG. 9 is an elementary section of the circular mirror zone of the parabolic reflector, this mirror zone section belonging to a certain value of an angle $\phi$ between the axis p—p and the variable coordinate-line starting from the focal point F towards points K of the parabolic reflector. Point K in FIG. 9 is a point on the circular mirror-zone of the parabolic reflector 12 subtending an angle $\nu$ (nu), whereas point A is an elementary point of the light-emitting incandescent body located at a distance a from the focal point F of the parabolic reflector 12. As shown, point F is disposed at a distance f from the intersection of axis f—f with the reflector 12.

The distance a is treated as a variable, and thereby, A represents a plurality of possible elementary points of the light-emitting incandescent body. The total length of the latter together with its location alongside the axis a—a can be easily defined by a pair of limiting values of a. Since light beams from each point A in between said limiting values of a, i.e. being light-emitting points of the incandescent body, arrive at the light pattern screen after refraction in the mirror zone defined by a pair of limiting values of the angle $\varphi$, a three-dimensional curve consisting of points of intersection T with the surface of the body of rotation, in particular with that of the cylinder of radius $\rho$, belongs to one of the mirror zones, particularly to that defined by a certain value of angle $\varphi$, the resulting three-dimensional curve forming the contour of the rim of the screen element will be the envelope curve of the described family of curves for different values of $\varphi$ extending from one to the other of the aforesaid limiting values of same.

By inserting practical data for radius $\rho$, distance a and angle $\varphi$, the envelope curve can be numerically calculated preferably by computer for any prescribed light pattern and for any body of rotation of radius $\rho$. On basis of the above description of the elementary geometrical interrelations shown in FIG. 9, it can be easily seen that the envelope curve defining the rim of the screen element is a multi-variable function of the prescribed positions of Q, i.e. of the form of the boundary line dark-bright of the light pattern and the values of a and $\varphi$, and in addition to that of $\rho$. The radius may be constant (mantle of a cylinder) or variable (surface of some other body of rotation) and depending on the preselected value or function of the screen element may be developed with suitable dimensions and can be located either inside or outside the gas-filled interior space of a halogen lamp without essentially deviating from the light pattern of the light distribution aimed at.

On the basis of the description given above, it can be easily seen, that, within the scope of the invention and the protection claimed in the attached claims, depending on the field of application and the given circumstances, a plurality of embodiments can be also developed.

Although the invention is illustrated and described with reference to a plurality of preferred embodiments thereof, it is to be expressly understood that it is in no way limited to the disclosure of such preferred embodiments but is capable of numerous modifications within the scope of the appended claims.

I claim:

1. An electric light source for use in vehicle headlights capable of emitting a dipped beam, comprising a parabolic reflector arranged about a halogen incandescent lamp, with at least one incandescent body of said lamp being arranged inside the reflection space of the parabolic reflector adjacent the focal point of the parabolic reflector and said space being sealed off by a glass plate, a light screen element mounted around the incandescent body emitting the dipped beam, said screen element being effective to prevent the incidence of light on the parabolic reflector within a zone subtending at most 180° with successive planes perpendicular to the axis of the paraboloid of the parabolic reflector, the rim of the screen element being in the shape of a three-dimensional curve such that at most two points of the three-dimensional curve are located in any plane containing the axis of the paraboloid and extending radially from the said axis.

2. An electric light source according to claim 1, wherein the light source is a sealed beam vehicle headlight unit.

3. An electric light source, according to claim 1, wherein the points of the three-dimensional curve constituting the rim of the screen element are disposed in a zone between a horizontal plane passing through the axis of the paraboloid and another plane passing through the same axis and subtending an angle of ±30°.

4. An electric light source according to claim 1 wherein at least in certain zones of a lengthwise extension of the axis of the paraboloid, the points of the three dimensional curve forming the rim of the screen element are located on the surface of a body of rotation.

5. An electric light source according to claim 4, wherein the axis of said body of rotation is parallel to the axis of the paraboloid.

6. An electric light source according to claim 4, wherein the axis of said body of rotation is coaxial with the axis of the paraboloid.

7. An electric light source according to claim 4, wherein said body of rotation is at least a part of a cylinder.

8. An electric light source according to claim 4, wherein said body of rotation is at least a part of a cone.

9. An electric light source according to claim 4, wherein said body of rotation is at least a part of a sphere.

10. An electric light source according to claim 1, wherein the screen element is arranged inside the gas-filled interior of a two-filament halogen incandescent lamp.

11. An electric light source according to claim 1, wherein the screen element is arranged outside the gas-filled interior of a single-filament halogen incandescent lamp but inside the reflection zone of the reflector.

12. An electric light source according to claim 1, wherein an additional screen element is provided to prevent a direct incidence of emitted light on the said glass plate.

* * * * *